US007049619B2

(12) United States Patent
Hahn et al.

(10) Patent No.: US 7,049,619 B2
(45) Date of Patent: May 23, 2006

(54) DEVICE AND METHOD FOR DETECTING PAPER SHEETS ON A PALLET INCLUDING A POINT OF REFLECTION DISPLACEMENT

(75) Inventors: Thilo Hahn, Dettelbach/Brück (DE); Johannes Schaede, Würzburg (DE)

(73) Assignee: KBA-GIORI S.A., Lausanne (CH)

( * ) Notice: Subject to any disclaimer, the term of this patent is extended or adjusted under 35 U.S.C. 154(b) by 496 days.

(21) Appl. No.: 10/181,237

(22) PCT Filed: Jan. 24, 2001

(86) PCT No.: PCT/CH01/00052

§ 371 (c)(1),
(2), (4) Date: Jan. 17, 2003

(87) PCT Pub. No.: WO01/23289

PCT Pub. Date: Apr. 5, 2001

(65) Prior Publication Data

US 2005/0224731 A1 Oct. 13, 2005

(30) Foreign Application Priority Data

Jan. 26, 2000 (CH) ..... 0151/00

(51) Int. Cl.
*G06K 5/00* (2006.01)

(52) U.S. Cl. ..... 250/556; 250/559.4

(58) Field of Classification Search ..... 250/556, 250/559.4, 234, 224; 355/408
See application file for complete search history.

(56) References Cited

U.S. PATENT DOCUMENTS

| | | | | |
|---|---|---|---|---|
| 4,812,003 A | | 3/1989 | Dambach et al. | |
| 5,758,759 A | * | 6/1998 | Negishi | 250/556 |
| 5,847,405 A | * | 12/1998 | Acquaviva et al. | 250/559.36 |
| 6,144,038 A | | 11/2000 | Gerstenberger et al. | |

FOREIGN PATENT DOCUMENTS

| | | | |
|---|---|---|---|
| CH | 686201 | A | 1/1996 |
| DE | 19909518 | A | 10/1999 |
| EP | 0289185 | A | 11/1988 |
| FR | 2704642 | A | 11/1983 |
| JP | 58193849 | A | 11/1983 |
| JP | 61145042 | A | 7/1986 |

OTHER PUBLICATIONS

International Search Report in SN PCT/CH 01/00052.

* cited by examiner

*Primary Examiner*—Que T. Le
(74) *Attorney, Agent, or Firm*—John Moetteli

(57) ABSTRACT

The apparatus has at least one optical sensor (7, 8), which emits a light beam (13, 14), inclined at an angle in relation to the surface of the pallet (2), and irradiates the surface of the pallet (2) at a point of reflection, and supports (9, 10) with cylinders for displacing the point of reflection by a predetermined distance over the surface of the pallet (2).

13 Claims, 3 Drawing Sheets

DEVICE AND METHOD FOR DETECTING PAPER SHEETS ON A PALLET INCLUDING A POINT OF REFLECTION DISPLACEMENT

BACKGROUND OF THE INVENTION

The present invention relates to a device which makes it possible to detect the presence and the position of a ream of paper sheets, in particular sheets of securities or banknotes, on pallets. The present invention also relates to a method for such a detecting operation.

A problem which is frequently encountered in the production of printed sheets is the precise positioning of the sheet stacks on the pallets. This is because, in the case of a process for printing paper sheets, for example for securities or banknotes, sheet stacks are often transported on pallets from one machine to the other in order to run through the various steps of the process. It is thus the case that a sheet stack is fed to a given machine on a pallet and transferred into the inlet of the machine, the sheets ale introduced individually into the machine, in order for it to be possible for the machine to carry out its process step, for example printing, numbering or the like, and the sheet stack is reinstated on a pallet at the outlet of the machine.

In the case of an industrial production process, it is, of course, the case that, rather than just a single pallet being fed to the inlet of a machine, a continuous flow of pallets and sheet stacks is guided to and from each machine.

While the formation of sheet stacks at the outlet of a machine is straightforward, each sheet which has been processed by the machine passing out individually, it is more complicated for sheet stacks to be transferred from pallets to the inlet of the machine.

The sheets stacked up in a pallet have to be reliably transferred from the pallet to the feed table of the machine. This transfer operation call take place in various various for example, the pallet can be arranged on a feed table, on which the pallet is located in a known reference position of a transfer system; the transfer system, which comprises in particular a suitable gripper system for gripping the sheet stack, can be fed; a crosspiece can be lowered, in order for the pallet to be connected to the feed table of the machine, and the stack can be conveyed from the pallet to the feed table.

At this stage, it has appeared necessary to carry out sensing of the presence and of the position of the sheet stack on the pallet. This is because, if there is no sheet located on the pallet, it is necessary to avoid the above-described transfer process and to change the pallet instead and, if the sheet stack is positioned incorrectly on the pallet, for example if it is located too close to the border of the pallet on which the crosspiece is supported or if it is oriented obliquely, it may obstruct the movement of the crosspiece, which will then result in machine blockage and renders the intervention of an operator necessary. In the case of an industrial production process, such time losses are not acceptable and have to be reduced to a minimum.

Nevertheless, precise and reliable detection of the presence and/or of the position of a sheet stack on a pallet raises numerous problems.

A first problem is that it may be the case that the sheet stacks are supplied on pallets made of different material. It is thus possible for stacked sheets to be received on pallets made of metal, for example of steel, which have a reflective surface, or on pallets made of plastic, which have a matt surface. The sensing system thus has to be capable of sensing the presence of sheets or sheet stacks irrespective of the type of pallet used, each type of pallet, for this reason, having a different reflection coefficient.

A second problem is that sheets printed in different colors may affect the performance of the sensing system used: since the different colors have a different reflection behavior, it is possible that the sensing system may not be able to sense the presence of sheets on a given pallet.

Finally, where securities or banknotes are concerned, holograms are often used as a security element. A hologram, however, likewise appears to affect the performance of the sensing system. On account of the particular reflection behavior of a hologram, it may be the case that the sensor used does not sense the presence of sheets, to be precise in particular if the sensing operation takes place at the location where the hologram is situated. It is difficult, or even impossible, for the sensor to be reliably adjusted for definite sensing.

SUMMARY OF THE INVENTION

The object of the invention is thus to develop a device and a method which are reliable and are not influenced by external parameters, for example the material of the pallets, the color of the print or the presence of security elements, for example holograms or the like, on imprints.

This object is achieved by the device and the method defined in the claims.

Since the optical sensors emit a light beam which is inclined in relation to the surface of the pallet and are displaced by a certain distance, it is possible to avoid the problems caused by the material of the pallets and the colors used for printing.

The invention has numerous advantages, and it may be mentioned, in particular, that the apparatus is easy to produce and reliable to use.

BRIEF DESCRIPTION OF THE DRAWINGS

The invention may be better understood by way of the description of in embodiment thereof and the figures relating thereto.

DETAILED DESCRIPTION OF THE PREFERRED EMBODIMENT(S)

Figure 1:
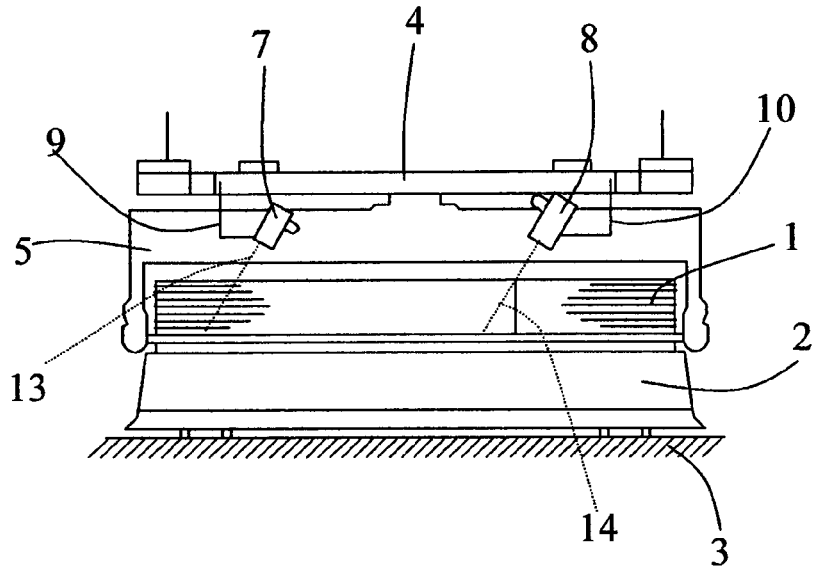
FIG. 1 shows a front view of a device according to the invention.

The apparatus will be described first of all with reference to FIG. 1.

Figure 3:
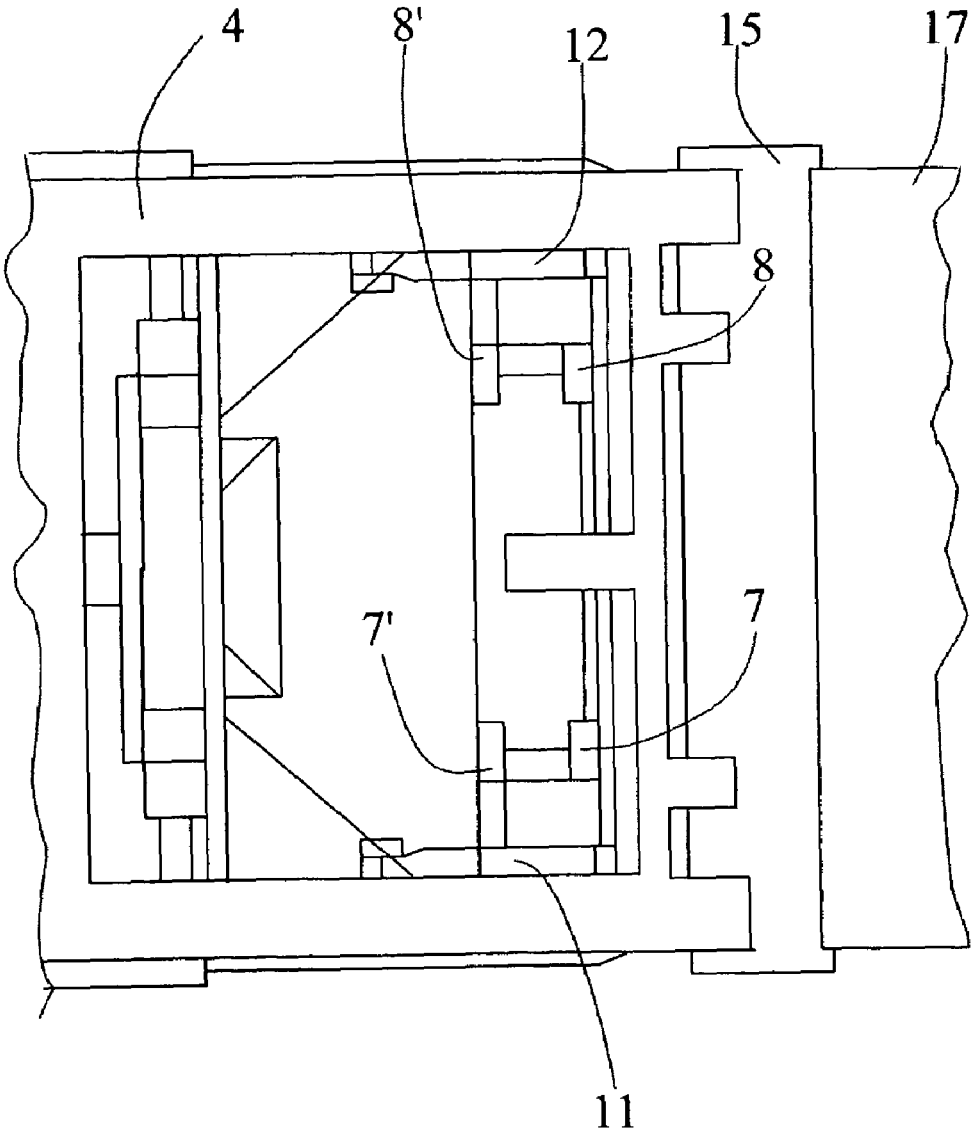
FIG. 3 shows a plan view of the device according to FIG. 1.

This figure illustrates a sheet stack 1 on a pallet 2, the pallet 2 being arranged on an aligning table 3. Provided above the stack 1 is a frame 4, which can be lowered and raised again above the stack. This frame 4 supports, in particular, a gripper system 5, which can move the pallets, and a detecting system. The detecting system comprises two optical sensors 7 and 8, which are fastened on the supports 9 and 10. The Supports 9 and 10, in turn, are fastened on the frame 4 by means of compressed-air cylinders 11 and 12 (see FIG. 3), which allow the optical sensors 7 and 8 to move between a starting position and an end position. This end position is illustrated schematically in FIG. 3 by the optical sensors 7' and 8'. The distance between the starting position and the end position may be adjusted by moveable stops. It is thus possible for the system to be adapted to different sizes of hologram. The optical sensors 7 and 8 each emit a light beam 13 and 14 of which the reflection on the pallet 2 is used for the sensing operation. The sensors 7 and 8 each emit a light beam 13, 14 which rather than running perpendicularly to the surface of the sheets of the stack 1, that is to say of the pallet 2, is angled, preferably by 40°, in relation to the surface of the stack, in order not to be adversely affected by the different reflection coefficients of the pallets, or by the color of the prints on the paper.

Figure 2:
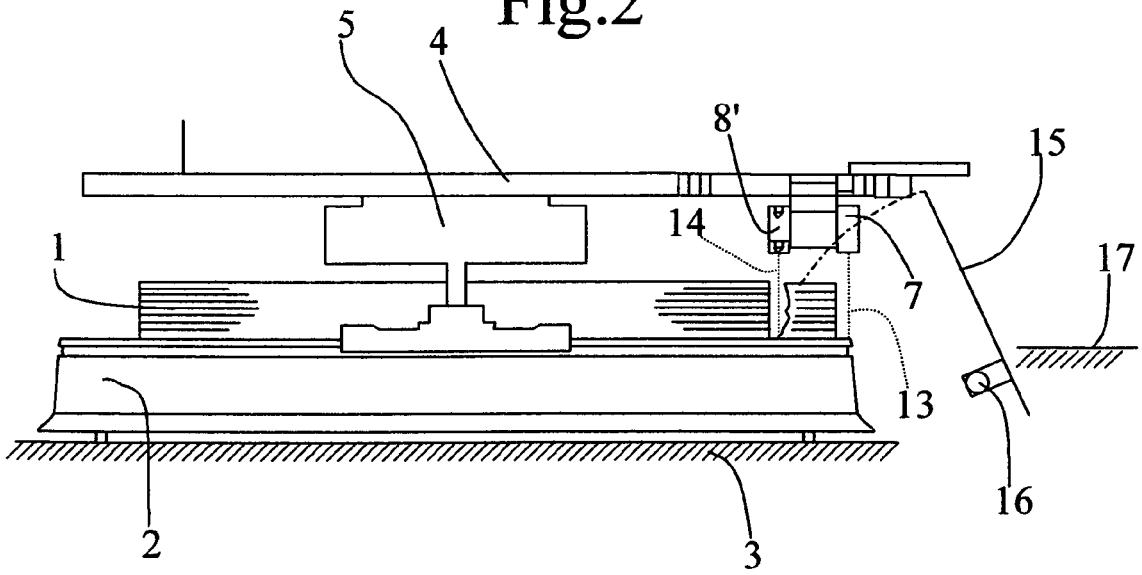
FIG. 2 shows a side view of the device according to FIG. 1.

FIG. 2 illustrates, in particular, the sensor 7 with its beam 13 in the starting position and the sensor 8' with its beam 14' in the end position. FIG. 2 also shows a crosspiece 15, which pivots about the axis 16 in order to allow it to be positioned on the pallet 2 and to allow transfer of the sheet stack 1 to the feed table 17 of the machine.

In the situation illustrated in FIG. 2, the sheet stack 1 has been offset to the right on the pallet 2, that is to say in the direction of the crosspiece 15, and the latter cannot be lowered properly. The detection takes place as follows: the sensors 7 and 8 are aligned with the border of the pallet 2 in their starting position. The sensors are switched on in order to emit their respective beams 13 and 14, and they are then displaced laterally by means of the cylinders 11 and 12, with the result that they arrive in an aligned manner in the end position, which is illustrated symbolically by the sensor 8' in FIG. 2. While sensing the presence of the stack 1 during the displacement of the sensors between two reference positions, it is easily possible to establish whether the sheet stack 1 is located in an acceptable position or whether it is located too close to the border of the pallet 2.

In exactly the same way as it is detected whether the sheet stack 1 has been displaced on the pallet, it is also possible, by means of the present invention, to establish whether one or more sheets of the stack 1 project and may possibly obstruct the positioning of the crosspiece 15.

It is, of course, necessary for the above-described apparatuses to be assigned to position sensors, in particular for the compressed-air cylinders 11 and 12, and to a central electronic-management unit, which makes it possible to analyze the data received from the optical sensors, to track the movement of said sensors between their reference positions (the starting position and the end position) and to produce a suitable control signal in dependence on the detection which has taken place, for example an error signal it the stack 1 is positioned incorrectly and a control signal for continuing the process (for example lowering the crosspiece 15) if the stack 1 is located in an acceptable position. This list of control signals is obviously not exhaustive and depends on the apparatus in question. It would also be possible, for example, to use the gripper system 5 for correcting the position of the stack 1 if the latter is located too close to the border of the pallet 2. For this purpose, the signals produced by the optical sensors can be used in order to calculate the displacement necessary for correction purposes, and the sensors can then confirm the correction which has been carried out.

Different types of apparatuses may be assigned to end stops in order to sense the arrival of the sensors, for example proximity sensors or the like.

Figure 4:
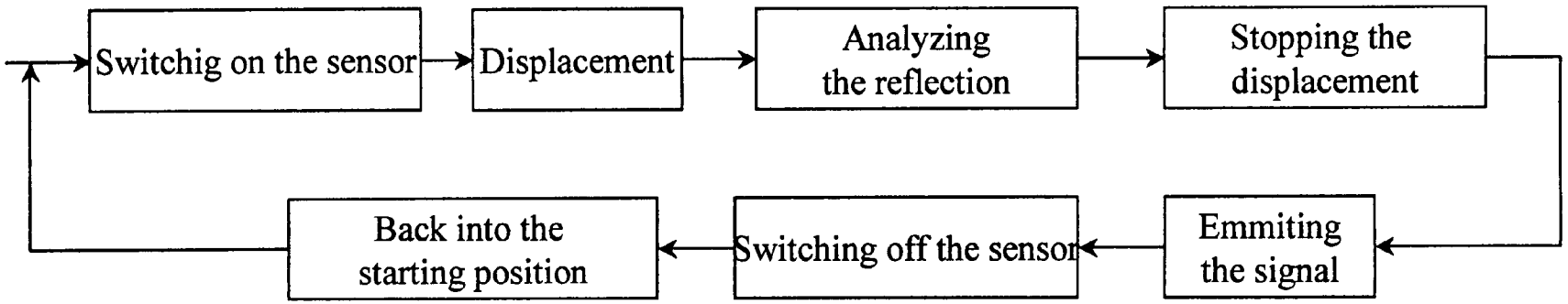
FIG. 4 shows a block diagram of the process according to the invention.

The method according to the invention is illustrated in the block diagram according to FIG. 4 and comprises the following steps:

switching on the sensor, displacing the sensor by a predetermined distance.

continuously analyzing the reflected light signal for sensing the presence of sheets, stopping the sensor at the end of the path, emitting a suitable signal in dependence on the sensing result, switching off the sensors and guiding the sensors back into their starting position.

The inclination of the light beams in relation to the surface of the sheets is preferably 40°. Slight deviations from this value are, of course, possible.

Furthermore, the example described contains two sensors in order for it likewise to be possible to sense a sheet stack which is oriented obliquely on the pallet.

Furthermore, the length of the path over which the sensors are displaced depends on the imprints located on the sheets. In particular, as has been seen above, it is necessary, if the imprints contain a hologram and if the light beam comes into contact with the hologram, to cover a path % which is of a greater dimension in the displacement direction than the hologram, in order to move past the latter and to carry out the detection operation over a part of the sheet which does not contain any hologram. This path could thus be shorter if the sheets do not contain any hologram, and time could thus be saved during this step.

Of course, other modifications are also possible within the scope of the invention.

Although illustrative embodiments of the invention have been shown and described, a wide range of modification, change and substitution is contemplated in the foregoing disclosure and in some instances, some features of the present invention may be employed without a corresponding use of the other features. Accordingly, it is appropriate that the appended claims be construed broadly and in a manner consistent with the scope of the invention.

The invention claimed is:

1. A device for detecting the presence of paper sheets, in particular sheets of securities or banknotes, on a pallet, wherein the device has:

at least one optical sensor, which emits a light beam, inclined at an angle in relation to the surface of the pallet, and which irradiates the surface of the pallet at a point of reflection, means for displacing the point of reflection by a predetermined distance over the surface of the pallet between a start position and an end position, and means for analyzing the light signal generated by reflection for sensing the presence of sheets during the displacement of the point of reflection and for generating a signal dependent on a detection result.

2. The device as claimed in claim 1, wherein the angled inclination is approximately 40°.

3. The device as claimed in claim 2, wherein it contains two symmetrical sensors.

4. The device as claimed in claim 1, wherein the means which allow the point of reflection to be displaced are formed at least by a compressed-air cylinder which acts on a support, on which each sensor is fastened, such that the sensor is displaced parallel to the surface of the pallet.

5. The device as claimed in claim 1, wherein the displacement takes place over a predetermined distance.

6. A method for sensing a ream of paper, in particular a ream of securities or banknotes, on a pallet by means of at least one optical sensor which emits a light beam onto a point of reflection, the process comprising the following steps:

switching on the sensor, displacing the point of reflection, analysing a reflected light signal for sensing the presence of sheets, stopping the movement of the point of reflection, emitting a suitable signal depending on the result of the sensing step, switching off the sensor.

7. The method as claimed in claim 6, wherein the displacement of the point of reflection takes place by linear displacement of the sensor by a predetermined distance running parallel to the surface of the pallet.

8. The method as claimed in claim 6, wherein the predetermined distance is greater than the dimension of a hologram provided on the paper.

9. The method as claimed in claim 6, wherein it uses two symmetrical sensors.

10. The device as claimed in claim 1, wherein the distance between starting position and end position is adjustable.

11. The device as claimed in claim 1, comprising a gripper system for correcting the position of the pallet depending on the result of the detection.

12. The device as claimed in claim 11, wherein the correction carried out by the gripper system can be determined by the sensors.

13. The device as claimed in claim 5, wherein the displacement taking place over a predetermined distance is superior in size to that of a hologram present on the sheets.

* * * * *